US005531032A

United States Patent [19]

Wooderson et al.

[11] Patent Number: 5,531,032

[45] Date of Patent: Jul. 2, 1996

[54] HAIR DRYER WITH INTEGRAL STEREO AUDIO SYSTEM

[75] Inventors: Blaise M. Wooderson; Lewis A. Mendelson, both of Industrial Airport, Kans.

[73] Assignee: Dazey Corporation, New Century, Kans.

[21] Appl. No.: 361,734

[22] Filed: Dec. 22, 1994

[51] Int. Cl.[6] ..... F26B 19/00

[52] U.S. Cl. ..... 34/90; 34/99

[58] Field of Search ..... 34/90, 91, 96–101, 34/283

[56] References Cited

U.S. PATENT DOCUMENTS

| | | | |
|---|---|---|---|
| 2,541,980 | 2/1951 | Antone | 179/1 |
| 3,230,320 | 1/1966 | Kerr | 179/146 |
| 3,237,713 | 3/1966 | Leslie | 181/31 |
| 4,020,284 | 4/1977 | Phillips | 179/1 E |
| 4,038,759 | 8/1977 | Dyer et al. | 34/99 |
| 4,210,784 | 7/1980 | Phillips . | |
| 4,641,014 | 2/1987 | Bland | 34/90 |

OTHER PUBLICATIONS

1987 Dellco Catalog, p. 151.

1992–1993 Service Merchandise Jewelry and General Merchandise Catalog, p. 303.

Lady Carel Salon Hair.

Lady Dazey.

Lady Dazey 1400 Hair Dryer.

Dazey Natural Wonder 1400.

*Primary Examiner*—Henry A. Bennett

*Assistant Examiner*—Susanne C. Tinker

*Attorney, Agent, or Firm*—Litman, McMahon and Brown

[57] ABSTRACT

A bonnet style hair dryer includes integral left and right speakers. Each of the speakers is positioned proximate a respective ear of the user. A two conductor stereo audio cable is separately attached to each speaker with the opposite end connected to an audio jack. The speakers can thus be connected, via a removable external audio cable, to any suitable audio source, including radio, television audio, stereo music source, etc. so that a user can receive audio entertainment or information while her or his hair is being dried. At the same time, should the user not desire to listen to audio programming, the external cable can be easily removed and the entire stereo audio system becomes virtually invisible from the exterior of the hair dryer.

10 Claims, 2 Drawing Sheets

HAIR DRYER WITH INTEGRAL STEREO AUDIO SYSTEM

BACKGROUND OF THE INVENTION

1. Field of the Invention

This invention is directed to a hair dryer with a bonnet which is lowered over a user's head and into which heated air is blown for drying purposes. More particularly, the inventive hair dryer includes an integral stereo audio system with a pair of stereo speakers which are physically built into the bonnet, with one speaker placed proximate to each ear of the user. An audio jack is connected to the speakers and a removable external audio cable allows the speakers to be connected to any suitable source of audio information or entertainment.

2. Description of the Related Art

Hair dryers equipped with bonnets through which heated air is blown to dry a user's hair have been known for some time. This type of hair dryer is a staple of commercial hair salons since it dries hair much faster, more evenly and more thoroughly than hand held "blow dryers". Bonnet style hair dryers for home consumer use have also been available, but in recent years have largely been superseded by hand held blow dryers. One problem with bonnet style hair dryers. for home use is the need for the user to remain stationary for a relatively long time period. This situation, coupled with the necessity to wear a bonnet which prevents the user from accessing audio entertainment or information such as radio, television audio or music sources, has limited the popularity and marketability of consumer-oriented bonnet-style hair dryers.

It is clear then, that a need exists for a bonnet style hair dryer which allows a user to access audio entertainment or information while the hair dryer is in use. At the same time, such a hair dryer should be attractive, relatively simple and economical to produce and sell, should not incorporate unnecessary electronic components which are subject to failure during the life of the hair dryer, and should be selectively connectable to any suitable audio entertainment or information source.

SUMMARY OF THE INVENTION

In the practice of the present invention, a bonnet style hair dryer includes a bonnet with an integral stereo audio system with a pair of stereo speakers. One of the speakers is positioned proximate each ear of a user when the bonnet is placed over his or her head. A two conductor stereo audio cable is separately attached to each speaker and extends between the speakers and a telephone type audio input jack. A removable external audio cable is selectively connectable between the audio input jack and any suitable audio source, including radio, television audio, stereo music source, etc. so that a user can conveniently receive stereo or monaural audio entertainment or information while his or her hair is being dried.

OBJECTS AND ADVANTAGES OF THE INVENTION

The principle objects and advantages of the present invention include: to provide a bonnet style hair dryer with an integral stereo audio system; to provide such a hair dryer in which a pair of stereo speakers are integrally attached within the bonnet with each speaker positioned proximate a respective ear of a user; to provide such a hair dryer in which the stereo speakers are connected to a telephone type audio jack positioned within the bonnet with an opening extending through an outer shell of the bonnet; to provide such a hair dryer in which an external audio cable is selectively connectable between the audio jack and any suitable source of audio information or entertainment; to provide such a hair dryer which allows a user to conveniently access audio entertainment and information while his or her hair is being dried; to provide such a hair dryer in which the stereo audio system is virtually invisible when the external audio cable is removed; and to provide such a hair dryer which is attractive, reliable, economical to manufacture, and which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
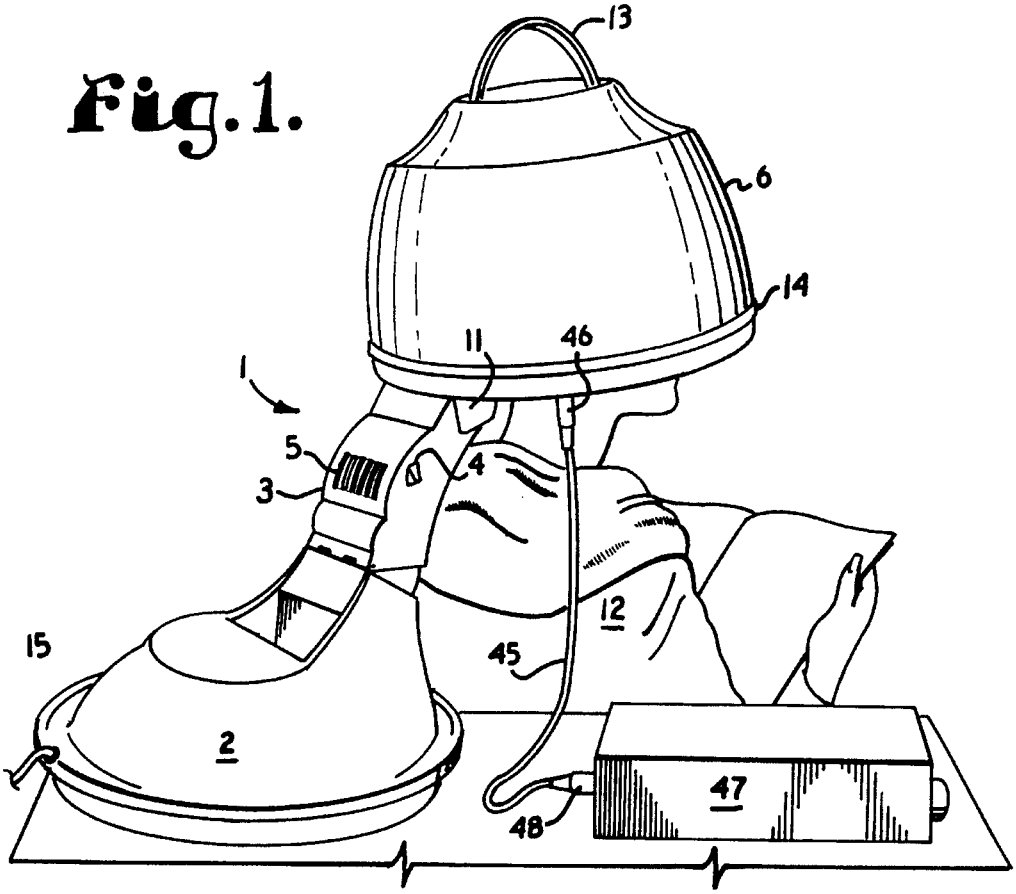
FIG. 1 is a perspective view of a bonnet style hair dryer in accordance with the present invention, with the bonnet positioned on a user's head and with an external audio cable connected between an audio input jack in the bonnet and an audio source.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting For example, the words "up", "down", "right" and "left" will refer to directions in the drawings to which reference is made. The words "inward" and "outward" will refer to directions toward and away from, respectively, the geometric center of the embodiment being described and designated parts thereof. Said terminology will include the words specifically mentioned, derivatives thereof and words of a similar import.

II. Hair Dryer

Referring to the drawings in more detail, FIG. 1 illustrates a bonnet style hair dryer according to the present invention, generally designated as 1. The hair dryer 1 includes a base 2 within which is housed a heating element, motor and fan (not shown). The base 2 is hingedly connected to a lower end of a damper neck portion 3 within which a variable damper (not shown) is positioned. A damper control 4 is attached to control the damper position within the neck portion 3. With the variable damper and the damper control 4, drying air from the blower in the base 2 can be selectively diverted out of a louvered opening 5 or into a hair drying bonnet 6. The bonnet 6 is hingedly connected to the top end of the neck portion 3 by a hollow pivot connection 11 via which heated air is introduced into the bonnet 6 in a conventional fashion. The bonnet 6 is shown positioned over the head of a user 12. The bonnet 6 also includes a carrying strap 13 attached to the top thereof and the bonnet 6 and the neck portion 3 can be selectively pivoted backward such that a sealing grommet 14 which encircles the bonnet 6 rests on a rim 15 of the base 2 to close the hair dryer into a compact package for storage or transport.

III. Hair Dryer Bonnet and Integral Stereo Audio System

Figure 2:
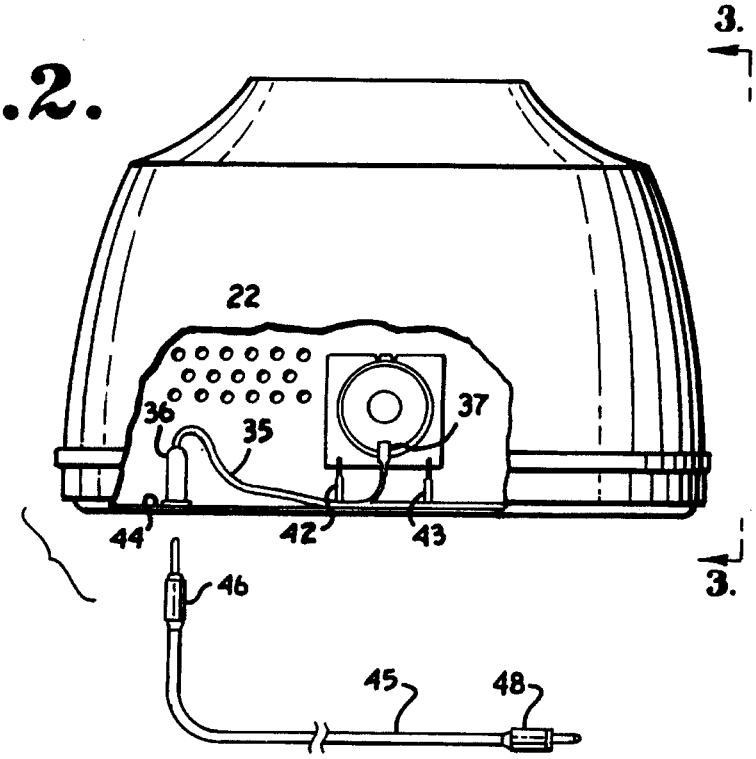
FIG. 2 is a side elevational view of the hair dryer bonnet, with portions broken away to illustrate the mounting, of a stereo speaker on one side of the bonnet and the position of an audio cable and input jack within the bonnet, and with the external audio cable positioned for connection to the audio input jack.
Figure 3:
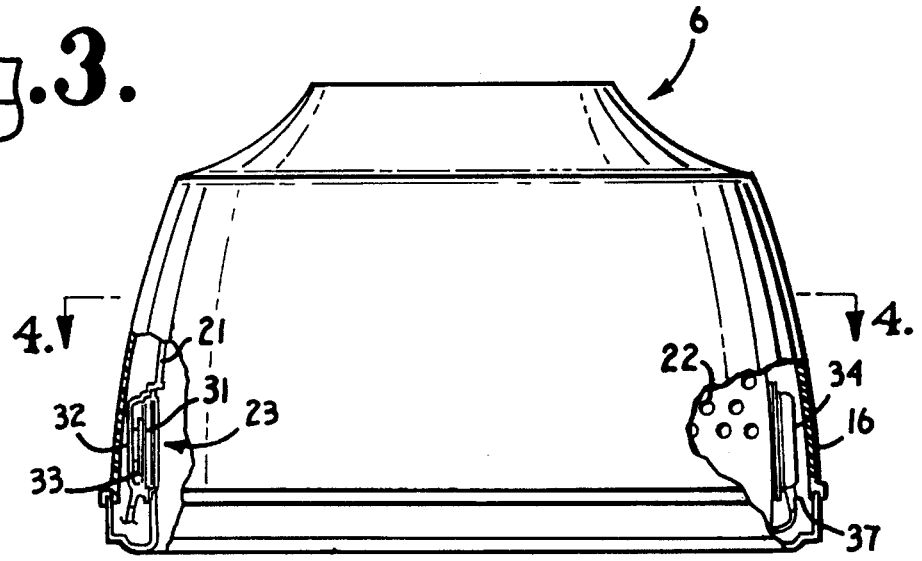
FIG. 3 is a front elevational view of the hair dryer bonnet, with portions broken away to illustrate the mounting of stereo speakers on each side of the bonnet, and with one of the speakers shown in cross-section to illustrate the interior construction thereof.
Figure 4:
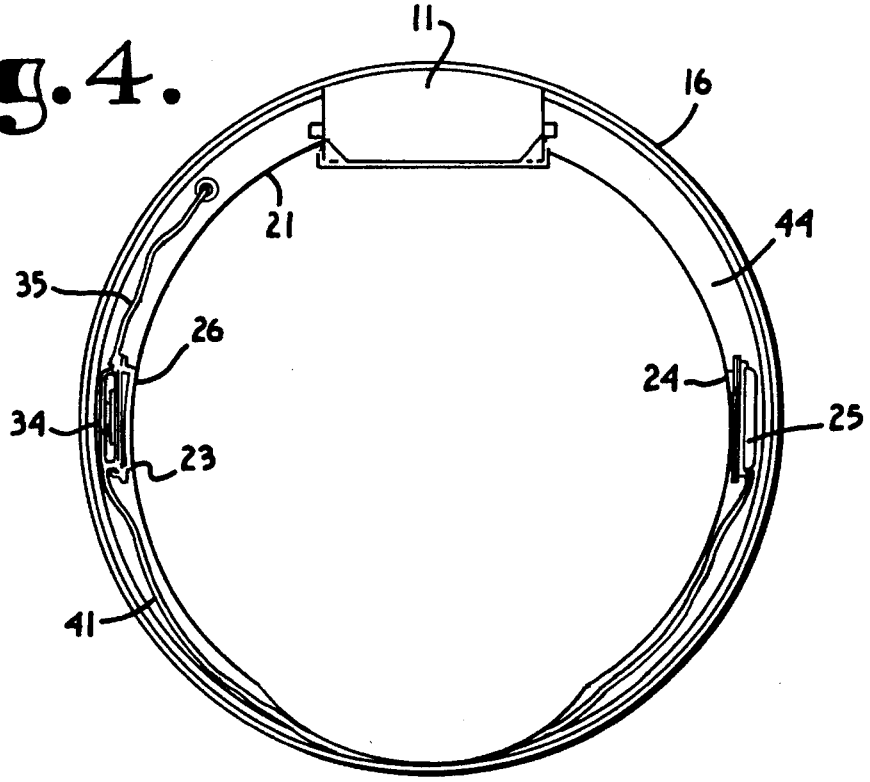
FIG. 4 is a cross-sectional view of the hair dryer bonnet, taken along line 4—4 of FIG. 3, and illustrating the relative positions of the stereo speakers and the routing of an audio cable between the audio jack and the right speaker and between the speakers themselves.

Referring to FIGS. 2–4, the bonnet 6 includes an outer shell 16 and an inner liner 21. The inner liner 21 is perforated with a plurality of air circulating apertures 22. Heated air is circulated between the outer shell 16 and the inner liner 21 and reaches the hair of the user 12 via the apertures 22.

The inner liner 21 includes left and right circular openings 23 and 24 which are positioned proximate the left and right ears, respectively, of the user 12. Left and right speakers 25 and 26, respectively, are positioned within the openings 23 and 24. The speakers 25 and 26 are identical and thus only the right speaker 26 will be described in detail. The speaker 26, which is illustrated in cross section in FIGS. 3 and 4, includes a movable diaphragm 31 to which is attached a coil 32 positioned within a permanent magnet 33. An outer seal 34 encloses the diaphragm 31, coil 32 and magnet 33.

A two conductor stereo audio cable 35 is connected between a telephone type audio input jack 36 and the right speaker 26. As is conventional in stereo audio cables, one conductor in the cable 35 is connected to the movable coil 32 in the speaker 26 via a clip-on terminal 37. A second conductor in the cable 35 extends, via a cable extension 41, around the periphery of the bonnet 6 between the outer shell 16 and the inner liner 21 to the left speaker 25 via a second clip-on terminal 37. Each of the speakers 25 and 26 is supported by a pair of supports 42 and 43 (FIG. 2) which connect to a continuous ledge 44 surrounding the interior base of the bonnet 6 and through which the input jack 36 extends. Stereo audio signals are thus input through the jack 36 via the two conductors in the cable 35 to respective ones of the speakers 25 and 26 such that the user 12 can conveniently listen to stereo or monaural audio information or entertainment while having her hair dried.

Referring to FIGS. 1 and 2, an external coaxial audio input cable 45 is shown connected at one end to the input jack 36 via a male plug 46, and, in FIG. 1, at the opposite end to an audio source such as radio 47 via a male plug 48. While a radio 47 is illustrated, it should be emphasized that the design of the inventive bonnet 6 allows the user 12 to be selectively connected to any suitable source of audio signals, including the radio 47, a television audio jack, CD or cassette player, or other source. At the same time, the fact that the input jack 36 is entirely hidden within the interior of the bonnet 6, with the external cable 45 being removable, insures that, during times that the user 12 does not desire to listen to audio programming, the integral stereo system is virtually invisible from the exterior of the hair dryer 1.

It is to be understood that while certain forms of the present invention have been illustrated and described herein, it is not to be limited to the specific forms or arrangement of parts described and shown.

What is claimed and desired to be secured by Letters Patent is as follows:

1. A bonnet style hair dryer, comprising:

a. a bonnet sized and positioned to accommodate the head of a user, said bonnet comprising:

i. an outer shell which is relatively impervious to air;

ii. an inner liner which is perforated to allow the passage of air therethrough;

b. means for heating air and introducing the heated air between the outer shell and the inner liner of said bonnet; and c. a first audio speaker integrally mounted within said bonnet, said first speaker being positioned between said outer shell and said inner liner and including a seal which seals off the first speaker from air circulating between said outer shell and said inner liner, said first speaker being positioned such that it directs sound through said inner liner to one ear of said user such that audio information can be conveyed to the user while his or her hair is being dried.

2. A bonnet style hair dryer as in claim 1, and further comprising:

a. a second audio speaker integrally mounted within said bonnet, said second speaker also being positioned between said outer shell and said inner liner and including a seal which seals off the second speaker from air circulating between said outer shell and said inner liner, said second speaker being positioned such that it directs sound through said inner liner to the opposite ear of said user.

3. A bonnet style hair dryer as in claim 1, and further comprising:

A. an audio input jack with an opening extending through said outer shell; and

B. a two conductor audio cable connecting respective stereo terminals in said audio jack to said first and second audio speakers, said audio cable being positioned between said outer shell and said inner liner.

4. A bonnet style hair dryer as in claim 3, and further comprising an external audio cable selectively connectable between said audio input jack and any suitable source of audio information or entertainment.

5. A bonnet style hair dryer as in claim 4, wherein said external audio cable is removable from said audio input jack.

6. A hair dryer bonnet sized and positioned to accommodate the head of a user, and comprising:

a. an outer shell which is relatively impervious to air;

b. an inner liner which is perforated to allow the passage of air passing from between said inner and outer liner to the user's head therethrough;

c. a first audio speaker integrally mounted within said bonnet and attached to said inner liner;

d. a second audio speaker integrally mounted within said bonnet and attached to said inner liner; and e. each of said first and second speakers being positioned between said outer shell and said inner liner and each including a seal which seals off the respective speaker from air circulating between said outer shell and inner liner, said first speaker being positioned such that it directs sound through said inner liner to one ear of said user and said second speaker being positioned such that it directs sound through said inner liner to the other ear of said user such that audio information can be conveniently conveyed to the user while his or her hair is being dried.

7. A bonnet as in claim 6 and further comprising:

a. an audio input jack positioned within said outer shell with an opening extending through said outer shell; and b. a two conductor audio cable connecting respective terminals in said audio jack to said first and second audio speakers, said audio cable being positioned between said outer shell and said inner liner.

8. A bonnet as in claim 7, and further comprising a removable external audio cable selectively connectable between said audio input jack and any suitable source of audio information or entertainment.

9. A hair dryer bonnet sized and positioned to accommodate the head of a user, and comprising:

a. an outer shell which is relatively impervious to air;

b. an inner liner which is perforated to allow the passage of air passing from between said inner and outer liner to the user's head therethrough;

c. a first audio speaker integrally mounted within said bonnet and attached to said inner liner;

d. a second audio speaker integrally mounted within said bonnet and attached to said inner liner;

e. each of said first and second speakers being positioned between said outer shell and said inner liner and each including a seal which seals off the respective speaker from air circulating between said outer shell and said inner liner, said first speaker being positioned such that it directs sound through said inner liner to one ear of said user and said second speaker being positioned such that it directs sound through said inner liner to the other ear of said user such that audio information can be conveniently conveyed to the user while his or her hair is being dried;

f. an audio input jack positioned within said outer shell with an opening extending through said outer shell; and g. a two conductor audio cable connecting respective stereo terminals in said audio jack to said first and second audio speakers, said audio cable being positioned between said outer shell and said inner liner.

10. A bonnet as in claim 9, and further comprising a removable external audio cable selectively connectable between said audio input jack and any suitable source of audio information or entertainment.

* * * * *